US006073917A

United States Patent [19]

Plummer

[11] Patent Number: 6,073,917

[45] **Date of Patent: *Jun. 13, 2000**

[54] CAPSTAN GUIDE RAMP COUPLING STRUCTURE AND METHOD

[75] Inventor: Jeffrey J. Plummer, Rockford, Ill.

[73] Assignee: Greenlee Textron, Inc., Rockford, Ill.

[ * ] Notice: Under 35 U.S.C. 154(b), the term of this patent shall be extended for 111 days.

[21] Appl. No.: 08/964,278

[22] Filed: Nov. 4, 1997

Related U.S. Application Data

[63] Continuation of application No. 08/645,253, May 13, 1996, abandoned.

[51] Int. Cl.[7] ..... B66D 3/04

[52] U.S. Cl. ..... 254/389; 254/374; 254/382; 242/602.2

[58] Field of Search ..... 254/382, 374, 254/371, 389; 242/602.2, 47.03, 47.01, 47.12

[56] References Cited

U.S. PATENT DOCUMENTS

| | | | |
|---|---|---|---|
| 1,734,832 | 11/1929 | Shanklin | 254/389 X |
| 2,329,943 | 9/1943 | Robins | 242/602.2 X |
| 2,424,760 | 7/1947 | Konkle | 254/371 X |
| 2,497,220 | 2/1950 | Humberson | 242/47.12 |
| 2,620,996 | 12/1952 | Le Bus | 242/602.2 |
| 3,753,551 | 8/1973 | Tidwell | 254/334 |
| 4,819,912 | 4/1989 | Plummer | 242/47.12 X |

FOREIGN PATENT DOCUMENTS

| | | | |
|---|---|---|---|
| 2920580 | 12/1980 | Germany | 254/382 |
| 147227 | 3/1981 | Germany | 242/47.01 |
| 259229 | of 0000 | Italy | 242/47.12 |

*Primary Examiner*—Donald P. Walsh
*Assistant Examiner*—Emmanuel M. Marcelo
*Attorney, Agent, or Firm*—Trexler, Bushnell, Giangiorgi & Blackstone, Ltd.

[57] ABSTRACT

A guide structure for guiding rope into turns of a helically wound arrangement of the rope upon a generally cylindrical capstan rotating to receive helical turns of the rope thereon, includes a helically ramped guide surface upon which the rope travels in winding into said turns and a support base formed on said guide structure and spaced from said guide surface. The guide structure has a coupling structure arranged for adjustably fixed coupling to a support structure on which the capstan is rotatably mounted. Multiple coupling structures are arranged to enable adjustably fixing spacial orientation of the ramped surface in relation to the capstan, in order to directionally adjust feed of the rope from the ramped guide surface onto the capstan to induce orderly arrangement of the rope turns on the capstan. In one embodiment, an annular arrangement of coupling sockets are provided on a rear support surface of the guide structure. The coupling sockets receive a smaller plurality of projections formed on the capstan support structure, and the guide structure can be rotatably indexed to allow radially adjusting the securement of the guide structure on the coupling projections to vary the spacial orientation of the ramped surface for the proper directional feed of the rope onto the capstan. The projections may be provided by the exposed ends of mounting bolts.

13 Claims, 2 Drawing Sheets

CAPSTAN GUIDE RAMP COUPLING STRUCTURE AND METHOD

This application is a continuation of application Ser. No. 08/645,253, filed May 13, 1996 now abandoned.

BACKGROUND

The present invention relates to power-winding equipment for pulling and loading turns of a rope or cable onto a "capstan". More particularly, the invention relates to improved guide devices assuring that the rope or cable is fed onto the rotating capstan surface for orderly winding of adjacent turns.

As described, for example, in U.S. Pat. No. 4,819,912, a helically ramped guide device has been developed for mounting on the power winding equipment which feeds the rope onto the rotating capstan to promote orderly winding of the rope thereon. The helical ramp device has an attached guide arm and both the guide arm and the helical lamp are free to rotate so as to allow self-adjusting angular feed and guidance of the rope along the helical ramp onto the capstan to produce orderly winding. In use of the freely rotating helical ramp and arm, however, certain operational problems can occur when the sufficiently large sliding friction of the rope passing along the ramp surface overcomes the static friction between the backside of the ramp and the stationary frame on which the helical guide ramp is mounted resulting in the helical ramp and arm actually rotating with the capstan, thus eliminating any rope feed guidance onto the capstan. When the helical ramp continues to rotate unchecked, the guide arm can strike a fixed object such as the frame of the power capstan drive unit. These and other disadvantages are eliminated by the improved guide unit in accordance with the present invention.

SUMMARY OF THE INVENTION

In accordance with the present invention, a guide structure is provided for guiding rope into helically wound turns upon a generally cylindrical capstan rotating to receive helical turns of the rope thereon. The guide structure includes a helically ramped guide surface against which the rope travels in winding onto said capstan and a support base formed on said guide structure and spaced from said guide surface. A coupling arrangement is provided for adjustably fixed coupling of the guide structure to a capstan support structure to which the capstan is rotatably mounted. Multiple coupling components are arranged to enable the guide structure to be positioned in a number of positions so that the orientation of the ramped surface in relation to the capstan may be varied in order to directionally adjust feed of the rope along the ramped guide surface onto the capstan to induce orderly arrangement of the rope turns on the capstan.

In one embodiment, an annular disposition of sockets or coupling pockets are provided on a rear surface of the guide structure. The coupling pockets receive a number of somewhat smaller protuberances on the capstan support structure. As such, the guide structure can be rotatably indexed to allow radially adjusting the securement of the guide structure on the coupling protuberance to variably fix spacial orientation of the ramped surface for the proper directional feed of the rope onto the capstan. In the illustrated embodiment, the protuberance are provided by bolt heads, as fastening means which maintains the capstan support structure in assembly.

DESCRIPTION OF THE PREFERRED EMBODIMENTS

Figure 1:
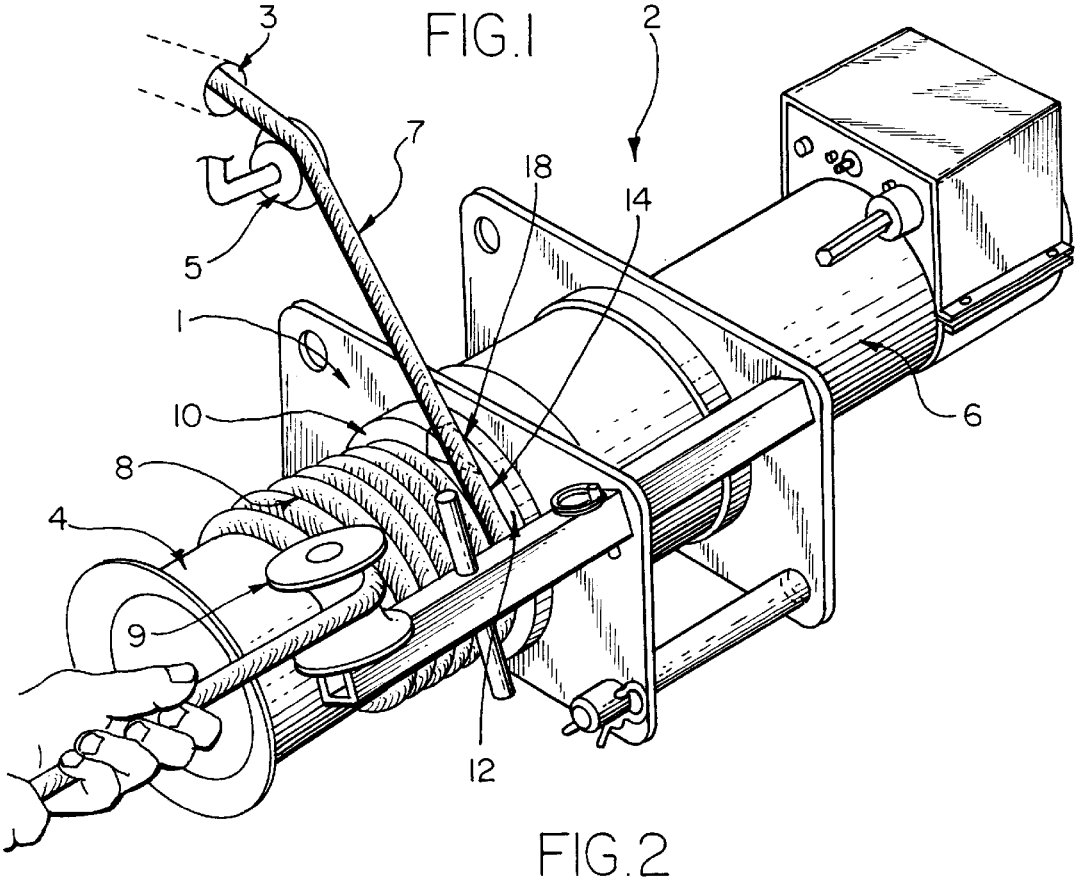
FIG. 1 is a perspective view of a power drive unit and capstan equipped with an embodiment of the improved, ramp guide device in accordance with the present invention.
Figure 2:
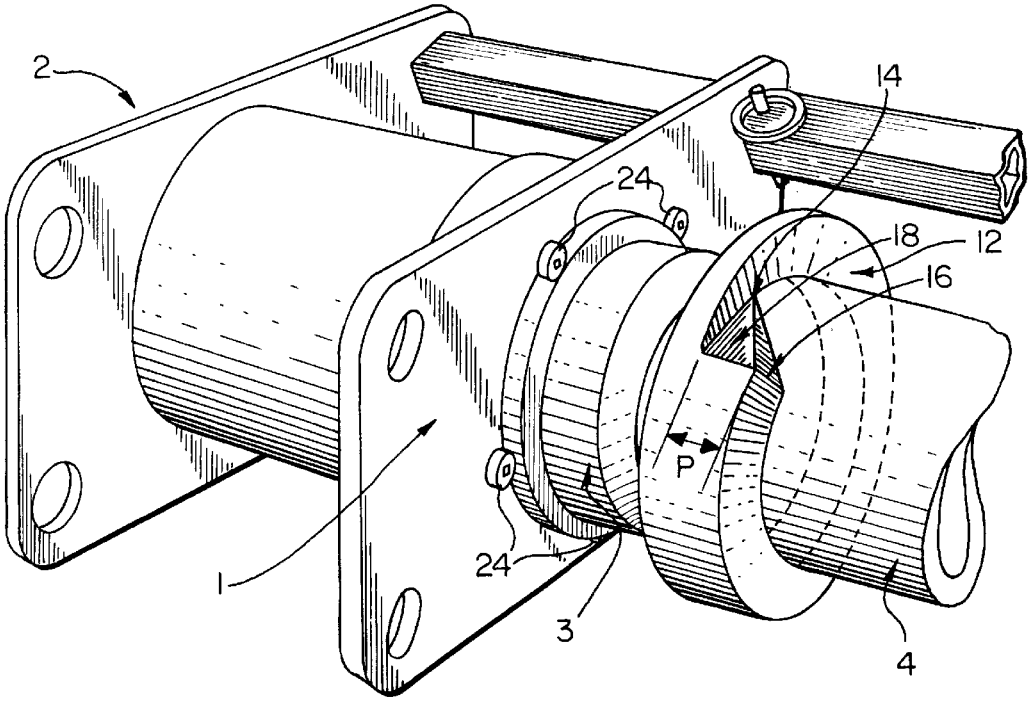
FIG. 2 is an enlarged, fragmentary perspective view of the power equipment shown in FIG. 1 in which the improved ramp guide device is shown disposed axially along the capstan, disengaged from the coupling protuberances, preparatory to adjustment of its relative position.

Referring initially to FIGS. 1 and 2, an embodiment of a ramped rope guide 10 in accordance with the present invention is shown adjustably mounted on the frame wall 1 of the support structure of a powered rope pulling unit 2. The unit 2 has a generally conventional "capstan" 4 rotated by a drive motor 6. The ramped guide 10 feeds the rope 7 onto the capstan surface adjacent to the driven capstan end 3 (FIG. 2) where the guide 10 progressively urges rope 7 axially outwardly onto the cylindrical surface of the capstan 4 into a uniformly wound helical rope pattern 8. The rope progressively leaves the helical pattern 8 and the surface of the capstan 4 by a manually tensioned withdrawal, preferably along a tensioning puny 9 as shown in FIG. 1.

The rope pulling unit 2, as shown in FIG. 1 is of the general type and kind used in pulling electrical cable through conduit. Once the conduit is installed in a building, it is necessary to pull the electrical cable to a junction box, or the like. A power unit, such as unit 2, FIG. 1, is employed with the rope 7 being affixed to the end of the section of cable to be pullied through the opening 3. While the present invention is illustrated and discussed with respect to an electrical cable pulling operation, it will be appreciated by those skilled in the art that it may be adopted to powered capstan or winch designs, without regard to the intended use thereof.

As best shown in FIG. 2, the guide 10 has a generally axially facing ramp surface 12 which is of a generally helical configuration beginning from a leading end 14 to the terminal end 16. The ramp surface 12 spirals in an arc which is less than 3600 and preferably in a range of 225°–330°, most preferably 270°. The guide has an inwardly inclined entry surface 18 leading the rope onto the ramp surface 12, preferably adjacent the leading end 14 thereof when the guide 10 is radially adjusted in accordance with the present invention to position the inlet surface 18 for passage of the rope leads 7 therethrough to the surface of the capstan 4 at the approximate location of the leading end 14 as shown in FIG. 1. The radial adjustment of the guide 10 in accordance with the present invention thereby accommodates the most convenient relative positioning of the power unit 2 relative to the conduit exit 3 and preferred feed pulley 5 from which the rope lead 7 is lead to the adjusted orientation of guide passageway 18 and capstan 4.

In the illustrated embodiment of the ramp guide 10, the rise P of the ramp as shown in FIG. 2 which is generally the axially extending width of the inlet surface 18, is selected based on the diameter of the rope or cable which is being pulled so that the rise P exceeds the diameter of the rope or cable to avoid any interference between turns as the rope winds its way outwardly along the capstan body 4 urged by the concentrically positioned ramp surface 12 which is adjustably fixed with the guide 10 relative to the rotating capstan.

Figure 3:
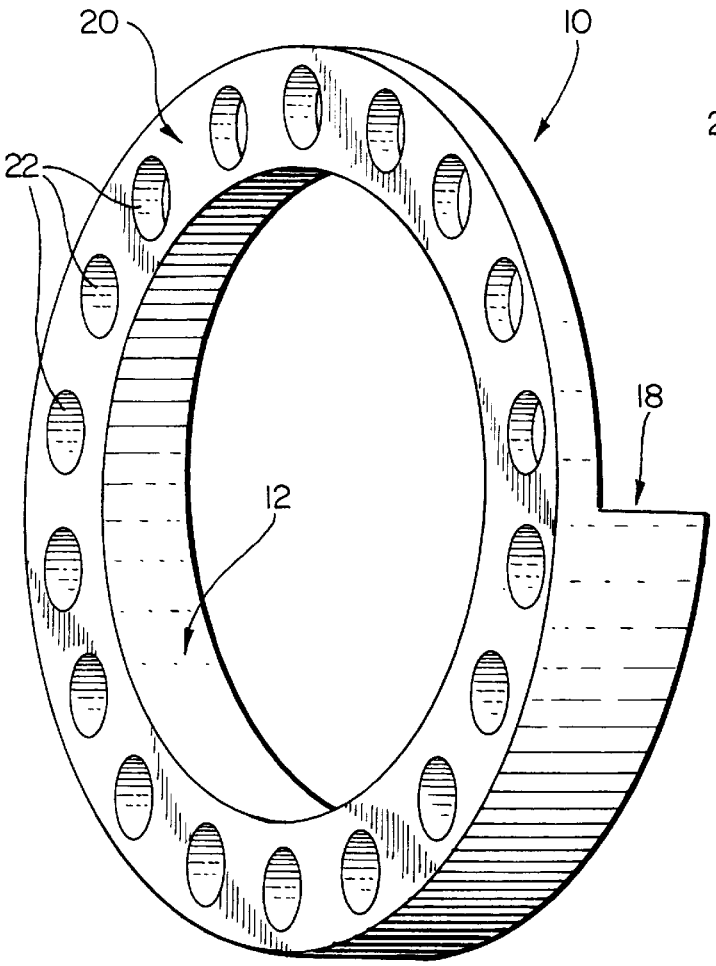
FIG. 3 is an enlarged perspective view of the ramp guide device in FIGS. 1 and 2 showing coupling sockets formed therein for adjustably mounting the ramp guide device to the capstan support structure.
Figure 4:
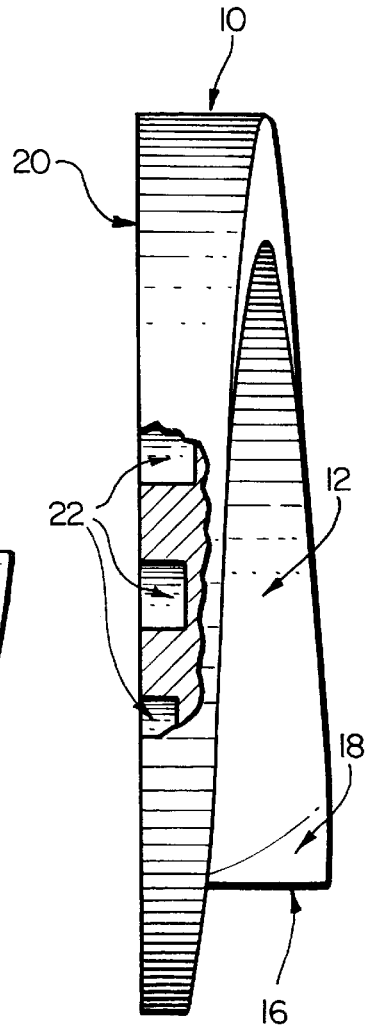
FIG. 4 is a side view of the ramp guide device of FIG. 3 partially broken away to show some of the plurality of sockets shown in FIG. 3.

Referring now additionally to FIGS. 3 and 4, in order to enable the radial adjustability of the operationally fixed, ramp guide 10, the longitudinally rearwardly facing base surface 20 of the ramp guide 10 is provided with a series of coupling sockets or pockets 22 which are arranged to respectively receive a plurality of coupling projections or protuberance 24 which extend from the wall support structure or frame 1. The disposition of the projections 24 inserted into the sockets 22, thereafter secure the ramp guide 10 against any rotation about the capstan 4. In operation, the force that the ramp 12 exerts on the engaged initial turn of the rope to push it outwardly winding on the capstan, will reactionally force the ramp guide 10 against the wall surface of the frame 1 to hold the ramp guide 10 against the frame wall 1 and prevent any longitudinal withdrawal of the protuberance 22 from sockets, so that the rope feed location of the inlet surface 18 remains operationally fixed.

In adjusting the guide 10 for a subsequent rope pulling operation for example at a cable conduit exit at a different location in relation to the unit 2, the ramped guide 10 can be manually pulled away from the frame wall 1 far enough to disengage the projections 24 from the sockets 22 and then rotationally adjusted to the most convenient position of the inlet surface 18 for feed of the rope onto the capstan in the necessary relative positioning of the pulling unit 2 with the next conduit exit 3. This condition is illustrated in FIG. 2. In this way, the ramp guide 10 can be correctly adjusted to match the direction the rope 7 approaches the pulling unit 2 so that the rope may always first contact the capstan most approximately adjacent to the leading end 14 of the helical ramp 12. The number of the different positions that the ramp guide can be indexed can be chosen by the number of sockets 22 provided. In the illustrated embodiment as shown in FIG. 2, the projections 24 and the pockets 22 are positioned in corresponding annular arrangements, and typically the number of pockets 22 will be a whole multiple of the number of posts 24, as governed by the degree of adjustability for the guide passageway 18. In the particular configuration of the illustrated embodiment, the projections 24 and pockets 22 have generally cylindrical configurations however, rectilinear or other corresponding coupling shapes could be employed. Also, the projections 24 are provided by exposed bolt heads, which fasteners are used to hold the frame wall 1, and other components of the unit 2 in assembly.

As a result of the adjustability in orienting the inlet surface 18 of the ramp guide 10 in accordance with the present invention, the angle of rope passage through the inlet 18 can always be assured to allow first contact of the rope adjacent the ramp leading end 14 so that the ramp imposes maximum and distributed force on the outwardly winding turns of the rope to ensure that the turns do not become overlapped and the orderly rope winding pattern 8 may be lead away from the capstan by the operator after the desired number of turns have been made. The magnitude of the load (not shown) which can be pulled by the rope and capstan depends upon the force applied by the operator and the mechanical advantages achieved through the use of the capstan as more fully explained in the aforementioned U.S. Pat. No. 4,819,912, the disclosure of which is incorporated herein by reference.

While a preferred embodiment of the present invention is shown and described, it is envisioned that those skilled in the art may devise various modifications and equivalents without departing from the spirit and scope of the invention as defined by the appended claims which are not limited by the foregoing disclosure.

The invention claimed is:

1. A guide structure for guiding rope into turns of a wound arrangement upon a generally cylindrical capstan rotating to receive said rope thereon, said guide structure comprising: a ramped guide member against which the rope travels in winding onto said capstan, said ramped guide member having a surface; a support member having a surface against which the surface of said ramped guide member is engaged; coupling structure on said surface of said support member and said surface of said ramped guide member for adjustably fixing the position of the ramped guide member relative to said support member as a result of contact between said surfaces of said ramped guide member and said support member in order to radially orient said ramped guide member to a selected position thereby to directionally adjust feed of said rope along said ramped guide onto said capstan to induce orderly arrangement of said rope turns thereon, without removal of any components of said coupling structure in attaining said adjustable fixing of said ramped guide member relative to said support member.

2. A guide structure according to claim 1, wherein a component of said coupling structure comprises a plurality of protuberances on one of said support member and said ramped guide member.

3. A guide structure according to claim 1, wherein a component of said coupling structure comprises a plurality of recesses on one of said support member and said ramped guide member.

4. A guide structure according to claim 1, wherein a component of said coupling structure comprises a plurality of protuberances on one of said support member and said ramped guide member and a plurality of recesses on the other of said support member and said ramped guide member, said protuberances received by said recesses to fix the position of the ramped guide member relative to said support member.

5. A guide structure according to claim 4, wherein said ramped guide member includes a helically ramped surface, wherein said plurality of protuberances are arranged in an annular sequence to enable rotatable indexing of the ramped guide member and radial orientation of said helically ramped surface thereof.

6. A guide structure according to claim 5, wherein said ramped guide member further comprises a rope entry passageway interrupting said helically ramped guide surface arranged to lead rope thereagainst.

7. A guide structure according to claim 4, wherein said plurality of recesses are smaller than said plurality of protuberances.

8. A method using a guide structure to guide rope into turns of a wound arrangement onto a generally cylindrical capstan, said guide structure including, a ramped guide member against which the rope travels in winding onto said capstan, said ramped guide member having a surface, and a support member having a surface against which the surface of said ramped guide member is engaged, and said guide structure including coupling structure on said surface of said support member and said surface of said ramped guide member, said method comprising: engaging the coupling structure on the support member and the ramped guide member to adjustably fix the position of the ramped guide member relative to the support member as a result of contact between said surfaces of said ramped guide member and said support member and relative to the orientation of the guide rope without removing any components of said coupling structure; engaging the rope with the ramped guide member; rotating said capstan; and receiving said rope along said ramped guide member onto said capstan.

9. A method according to claim 8, wherein the step of engaging the coupling structure on the support member and the ramped guide member comprises engaging a plurality of protuberances on one of said support member and said ramped guide member.

10. A method according to claim 8, wherein the step of engaging the coupling structure on the support member and the ramped guide member comprises engaging a plurality of recesses on one of said support member and said ramped guide member.

11. A method according to claim 8, wherein the step of engaging the coupling structure on the support member and the ramped guide member comprises engaging a plurality of protuberances on one of said support member and said ramped guide member and a plurality of recesses on the other of said support member and said ramped guide member, said protuberances received by said recesses to fix the position of the ramped guide member relative to said support member.

12. A method according to claim 11, further comprising engaging the rope with a rope entry passageway interrupting said ramped guide member.

13. A method according to claim 8, further comprising rotatably indexing the ramped guide member and radially orientating a helically ramped surface thereof by engaging a plurality of protuberances arranged in an annular sequence on said support member with a plurality of recesses on said ramped guide member.

* * * * *

UNITED STATES PATENT AND TRADEMARK OFFICE

CERTIFICATE OF CORRECTION

PATENT NO. : 6,073,917

DATED : June 13, 2000

INVENTOR(S) : Jeffrey J. Plummer

It is certified that error appears in the above-identified patent and that said Letters Patent is hereby corrected as shown below:

Column 2, Line 27, "puny" should be -- pully --

Column 2, Line 44 " 3600" should be -- 360° --

Signed and Sealed this

Third Day of April, 2001

Nicholas P. Godici

*Attest:*

NICHOLAS P. GODICI

*Attesting Officer*

*Acting Director of the United States Patent and Trademark Office*